United States Patent [19]

Nützel et al.

[11] Patent Number: 4,878,327

[45] Date of Patent: Nov. 7, 1989

[54] CORROSION PROTECTED TENSION MEMBER FOR USE IN PRESTRESSED CONCRETE AND METHOD OF INSTALLING SAME

[75] Inventors: Oswald Nützel, Munich; Egbert Zimmermann, Oberaudorf; Dieter Jungwirth, Munich, all of Fed. Rep. of Germany

[73] Assignee: Dyckerhoff & Widmann Aktiengesellschaft, Munich, Fed. Rep. of Germany

[21] Appl. No.: 167,631

[22] Filed: Mar. 14, 1988

[30] Foreign Application Priority Data

| | | | |
|---|---|---|---|
| Mar. 13, 1987 | [DE] | Fed. Rep. of Germany | 3708067 |
| Oct. 15, 1987 | [DE] | Fed. Rep. of Germany | 3734954 |
| Jan. 20, 1988 | [DE] | Fed. Rep. of Germany | 3801451 |

[51] Int. Cl.[4] ..... E04C 3/10

[52] U.S. Cl. ..... 52/230

[58] Field of Search ..... 52/230, 233 L, 233 R, 52/231, 725

[56] References Cited

U.S. PATENT DOCUMENTS

| | | | |
|---|---|---|---|
| 3,399,434 | 9/1968 | Kelly | 52/230 |
| 3,803,788 | 4/1974 | Finsterwalder et al. | 52/230 |
| 3,935,685 | 2/1976 | Howlett | 52/223 L |
| 3,967,421 | 7/1976 | Dufossez | 52/230 |
| 4,192,114 | 3/1980 | Jungwirth et al. | 52/223 L |
| 4,235,055 | 11/1980 | Schambeck | 52/230 |
| 4,363,462 | 12/1982 | Wlodkowski et al. | 52/230 |
| 4,594,827 | 6/1986 | Finsterwalder | 52/233 L |
| 4,633,540 | 1/1987 | Jungwirth et al. | 52/230 |
| 4,640,068 | 2/1987 | Jungwirth et al. | 52/223 L |
| 4,718,209 | 1/1988 | Hansen et al. | 52/230 |

FOREIGN PATENT DOCUMENTS 3224702 1/1984 Fed. Rep. of Germany .

OTHER PUBLICATIONS

The Cantilever Construction of Prestressed Concrete Bridges. Jacques Mathirat 1979.

"DYWIDAGL-Report", No. 11, 1982, pp. 2, 7, 59.

*Primary Examiner*—Carl D. Friedman

*Assistant Examiner*—Caroline D. Dennison

*Attorney, Agent, or Firm*—Toren, McGeady & Associates

[57] ABSTRACT

A corrosion-protected tension member, such as a tendon for prestressed concrete with post-tensioning, is made up of a bundle of individual tension elements, such as strands, arranged within a tubular envelope. The tension member extends between anchoring devices, each forming an anchor region for the tension member with a free region located between the anchor regions. In the free region, the tubular envelope is formed of a sheathing tube. Each individual element is located within a separate sheathing duct, and a corrosion-protection mass fills the space within the ducts about the elements. The open volume within the sheathing tube around the sheathed elements is filled with cement mortar. In the anchor regions, the tubular envelope includes an anchor tube enclosing an anchor pot. The anchor pot has a base with openings through which the individual elements pass in a sealed manner. The anchor pot is filled with a corrosion-protection mass. Accordingly, the individual elements are axially movable and retensionable along their entire lengths. The sheathing ducts and the anchor pot separate the cement mortar from the individual tension elements in the free region extending between the anchor pots.

41 Claims, 8 Drawing Sheets

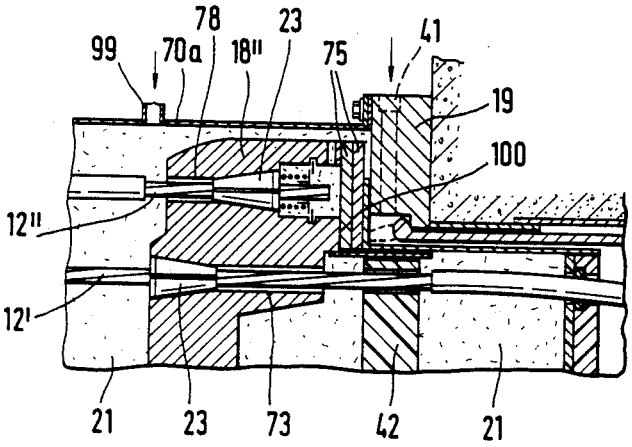
FIG. 20
FIG. 21
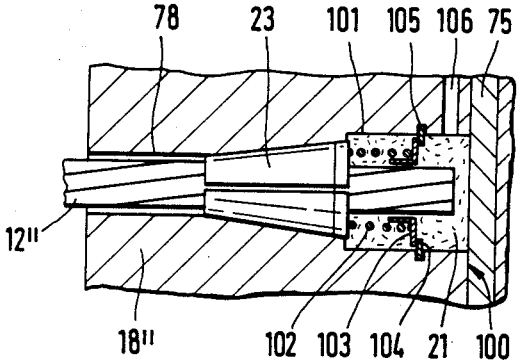
FIG. 22
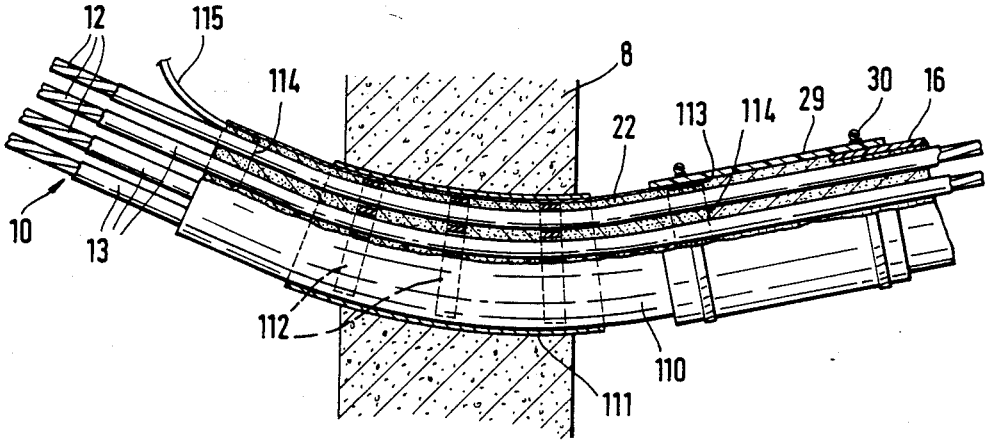

CORROSION PROTECTED TENSION MEMBER FOR USE IN PRESTRESSED CONCRETE AND METHOD OF INSTALLING SAME

BACKGROUND OF THE INVENTION

The present invention is directed to a tension member protected against corrosion, mainly a tendon for prestressing concrete with post-tensioning. The tension member is formed of at least one tension element, such as a steel rod, wire or strand, located within a tubular envelope with anchoring devices arranged at the ends of the tension member. The tension member extends between anchor regions at the anchoring devices, with a free region extending between the anchor regions. In the free region, the tubular envelope is formed of a sheathing tube and is tightly secured to the anchoring devices in the anchor region. Open spaces are provided between the individual tension elements within the tubular envelope and at least in the region directly adjoining the anchoring devices the open spaces are filled with a plastically deformable corrosion-protection mass. Further, the invention is directed to a method of installing the tension member in a concrete structural member.

In structural design, particularly of bridge structures formed of prestressed concrete, prestressing with pretensioning and with post-tensioning is known. Prestressing with pretensioning is performed mainly as prestressing with subsequent pretensioning where the tendons or tension members remain free to move until the concrete sets and are subsequently bonded to the structure by injecting grout. In prestressing with post-tensioning, the tension members are generally located outside of the concrete structure, though they are supported relative to the structure, they can be inspected at any time, and,, if necessary, retensioned or replaced.

Tension members used as tendons for prestressed concrete with post-tensioning, or as diagonal cables for stayed cable bridges or for the rehabilitation of structural members and other structural tasks, require permanent corrosion protection made up of two independent corrosion protected systems with each system being completely effective by itself. A known tendon of this type, (Dyckerhoff & Widmann Publication "DYWI-DAGL-Report", No. 11, 1982, page 7) is formed of a prestressed tendon surrounded by a polyethylene sheathing tube across the free region of the tendon. The annular space between the tendon and the sheathing tube is closed off at the ends of the tendon by seals and the annular space can be injected with a hardenable material, such as cement mortar. Such a hardening material forms the first corrosion protection system across the free region of the tendon, the second corrosion protection system is the sheathing tube itself. In the anchor regions, the sheathing tube is joined with a connecting tube and the connecting tube is joined to the anchoring plate of the anchoring device. To maintain the tendon so that it can be stressed, prestressed or replaced, the corrosion resistance in the anchor region is provided by a plastically deformable corrosion-protection mass, such as grease, filled under pressure into the annular space between the tendon and the connecting tube. Accordingly, in the anchor region, the first corrosion protection system is the corrosion protection mass and the second system is formed by the connecting tube joined to the anchoring plate.

With such an arrangement, doubtless there is the advantage that the use of a comparatively expensive corrosion protection mass can be limited to the anchor region, while the less expensive cement mortar is utilized for the free region of the tendon which represents a considerably larger volume. There is the disadvantage, however, that the cement mortar must be injected prior to the installation of the tendon, since the annular space in the free region of the tendon is not accessible after installation because an anchor tube is fixed to the anchoring plate. While this arrangement is acceptable in the case of individual tendons formed of a single tension rod, however, with bundled tendons, it is not acceptable, since the tendons could not be handled due to the great weight involved.

Furthermore, segmented fabrication of structures, such as the fabrication of bridge structures in the so-called time-shifting or incremental launching method often necessitates the provision of an additional tendon for a subsequent section to a tendon already anchored to the section, and the connection of such tendons, so that the entire tendon can be tensioned from the opposite ends.

For tendons with subsequent pretensioning so-called coupling points are known for joining the tendons. Thus, an anchoring and coupling device of one bundled tendon comprises one anchoring member which, in addition to conical bores for prestressed anchoring of the incoming tension members by means of wedges also has additional conical bores oriented in the opposite direction for anchoring the outgoing tension members (DE-PS No. 32 24 702). Such bores are arranged uniformly across the surface of the anchoring member. In this anchoring member, cylindrical bores follow the conical bores for anchoring the outgoing tensioning members and such bores are filled with a permanently plastic lubricating corrosion protection mass, whereby the tension elements are freely extended across these comparatively short. axial distances. By injecting the such as cement grout, a certain spring action of the tendon is utilized because of the short bond-free distance of the outgoing tension member, and the danger of crack formation in the coupling joint is reduced.

SUMMARY OF THE INVENTION

Therefore, it is the primary object of the present invention to provide a tension member which can be retensioned or replaced, especially a bundled tension member or tendon, where not only different corrosion protection material can be utilized in the anchor regions and in the free regions of the tension member, rather such materials can be applied independently of each other and without mutual interaction to a structure. It may even be possible to supply the material after the installation of the tension member. In addition, it is possible to construct a tension member of two or more axially extending sections coupled together in a friction locked manner.

In accordance with the present invention, each of the tension elements forming the tension member is enclosed in a sheathing duct formed of a plastics material, such as polyethylene and a plastically deformable corrosion protection mass fills the space between each tension element and the enclosing sheathing duct. The hollow spaces located between the individual ducts and the tubular envelope of the entire tension member is filled with a hardenable material, such as cement mortar, except in the regions directly adjoining the anchoring devices, into which the ducts of the tension elements penetrate. This region, adjoining the anchoring device, is filled with a plastically deformable corrosion protection mass.

Accordingly, the present invention provides a tension member or tendon, especially a bundled tendon, in which individual tension elements, preferably steel wire strands, are enclosed along the entire length, including the anchoring devices, by a plastically deformable corrosion protection mass, whereby the tension elements remain permanently axially movable and retensionable. By utilizing tension elements, enclosed within polyethylene ducts, as so-called greased strands, there is provided a limitation of the space to be filled with the plastically deformable corrosion-protection mass to the region immediately surrounding the individual tension elements and to the space directly adjoining the anchoring devices. The ducts for the tension elements provide a barrier between the corrosion protection mass enclosed in the ducts and surrounding the elements and the outer tubular envelope of the over-all tension member, so that the remaining open space within the tubular envelope can be filled with a hardenable material, such as low-cost cement mortar. Such a hardenable material not only affords a smooth transition at change in direction points during the expansion of the tensioning of the tension elements at the anchoring devices and at the change in direction points, but it also affords an additional protection if there is any failure of the grease corrosion protection.

In accordance with the invention, not only is free axial mobility of the tension elements forming the tension member maintained, there is also the advantage of installing such a tension member including its tubular envelope or enclosure with the further possibility of removing such a member if the tendon is only being utilized in the construction of a bridge, but is unnecessary in the finished bridge structure. Moreover, such a tendon can be replaced in the structure by another tendon if it were to become damaged. In accordance with the invention, the tubular envelope in the anchoring region is formed of an anchoring tube cooperating with an abutment member so that an anchoring pot can be inserted within the tube leaving an annular space between them. The anchoring pot has a number of openings in its base corresponding to the number of tension elements and, at its end spaced from the base, it has a flange forming an annular space, and the anchoring pot is filled with a plastically deformable corrosion protection mass.

The abutment member, against which an anchoring disc penetrated by the tension elements comes to rest, includes in an advantageous manner at least one injection and/or venting aperture for the hardenable material being charged into the annular space.

The anchoring tube inserted into a central opening of the abutment member preferably has a flange abutting against an annular shoulder formed in the opening. An elastic material sealing ring is preferably arranged between the flange of the anchoring tube and the annular shoulder.

The anchoring tube is provided with spaced protuberances arranged around its circumference at its end against which the anchoring pot rests. The anchoring disc can be provided with a tubular extension at its side facing the abutment member with the extension passing into the anchoring pot in a telescoping manner.

The advantage of the invention is that in the anchor region and particularly in the anchoring pot, there is a corrosion protection mass with the anchoring pot being placed in a simple assembly procedure on the tension elements previously inserted and then slipped into the anchoring tube. The anchoring pot, as compared to the anchoring tube, is shaped so that an annular space remains in the region of the abutment member where injection and/or venting lines are provided and which continues around its circumference with an annular space. The annular space affords a connection to the hollow space in the free region of the tension member outside the anchoring pot, so that it can be injected with a hardenable material, preferably cement mortar. Preferably, the anchoring pot prevents the material from penetrating into the anchor region and fixes the anchoring means, such as anchoring wedges.

The ducts enclosing the individual tension elements extend into the anchoring pot filled with corrosion protection mass and thus assure complete corrosion protection.

Additional advantages follow from the loose connection between the anchoring tube and the abutment member, in that the anchoring tube is provided with a flange at its end exposed to the atmosphere and can be pushed through the central opening of the abutment member, where it comes into contact with an annular shoulder. This simplifies the assembly, and, in addition, affords compensation for angular differences between the anchoring chute contacting the tension elements and the abutment member, particularly if an elastic material sealing ring is positioned between the flange of the anchoring tube and the annular shoulder. The tubular extension on the anchoring disc facilitates the installation by engaging within the anchoring pot and assuring a self-centering action.

The anchoring tube widens toward the anchoring device in a trumpet-like manner. An intermediate layer of an elastically and/or plastically deformable material, such as a plastics 1 material, can be located between at least the outer tension elements and the inner surface of the anchoring tube for affording a smooth transition of change in direction forces. The intermediate layer can be in the form of a ring in contact with the inside surface of the anchoring tube. In place of the intermediate layer, the outer tension elements can be conducted through a plastics material sheathing tube.

If comparatively short tension elements are used, the length of the anchoring pot is selected so that the ends of the plastics material sheathing ducts do not become displaced from the anchoring pot if changes in length of the plastics material sheathing ducts is caused by temperature differences. If comparatively long tension elements are employed, the plastics material sheathing ducts can be prevented from sliding out of the anchoring pot by providing an enlargement around their circumferences.

The anchoring tube is appropriately connected with the tubular envelope in the free region of the tension member in a tension-proof manner.

An expansion joint can be provided along the tension member to compensate for changes in length due to temperature differences. At the expansion joint, the tubular envelope is butt-jointed and the joint is tightly overlapped by an outer sleeve connected with a portion of the tubular envelope.

The hardenable material which fills the space outwardly of the individual sheathing ducts on the tension elements and the tubular envelope can be provided with reinforcement to avoid cracks.

To construct such a tension member or tendon in series from two or more axially extending sections, at least one of the anchoring devices can be constructed as a coupling member with the preferably circular anchoring disc abutted against the abutment member having bores for anchoring the incoming tension elements and additional bores for anchoring the outgoing tension elements. In addition, a sealing disc closes off the hollow spaces formed about the tubular ducts and is provided with openings for at least the outgoing tension elements and is arranged in the region of the outgoing tension elements spaced from the anchoring disc. The hollow space located between the sealing disc and the anchoring device is filled with a plastically deformable corrosion-protection mass, for instance grease.

Accordingly, it is possible to use such a tension member as a tendon for prestressed concrete with post-tensioning in structures to be constructed in sections, such as construction by incremental launching method type bridges.

The tubular envelope about the outgoing tension elements, in the region adjacent to the anchoring device is in the form of a casing, for instance, formed of metal, which can be connected in a sealed, as well as pressure and tension-proof manner. Further, it is detachable from the anchoring device and the tubular envelope in the free region of the tension member.

After the expansion of the outgoing tension elements towards the anchoring disc, the casing can be formed of a number of sections of different diameters and, further, can be made up of parts separate from one another in the sections of different diameters. Such parts are preferably displaceable with respect to one another in a telescoping manner and are detachably connected to one another.

Expediently, the sealing disc is located at a transition point between two sections of the casing with different diameters and the sealing disc can be detachably connected to the casing.

It is also possible to arrange the sealing disc as a spacer for the tension elements and for carrying change in direction forces oriented radially inwardly and caused by the increased spacing of the tension elements. The sealing disc is formed of two plates pressed against one another with sealing rings interposed between them and surrounding the tension elements where they pass through the plates.

A redirecting member laterally encircling the bundle of tension elements in an annular manner is arranged for carrying the change in direction forces oriented radially outwardly at the beginning of the spreading or further spacing apart of the tension elements. This redirection member is located inside the tubular enclosure or envelope and is detachably connected with it.

The tubular envelope, enclosing the tension elements in the free region of the tension member, extends into the redirection member forming an intermediate layer between the tension elements and the redirection member.

To arrange the outgoing tension elements in an orderly manner, an expansion ring, preferably formed of plastics material, is located in the region of the redirection member. At its outer circumference, the ring has receptacles for fixing the tension elements individually or in groups. These receptacles can be formed as radial webs. Further, the expansion ring can be constructed as a sealing disc. Where a tendon is post-tensioned, and is located outside of the concrete cross-section of a structural member, it is impossible, as a rule, to adapt the axis of the tendon or tension member to the course of the bending moments in a continuously curved manner. Generally, it is necessary to guide the tension member approximately at a multi-sided train.

As a result, change in direction points are formed where forces oriented toward the inside of the curve have to be carried. In the region of these change in direction points, the tubular envelope is conducted, in accordance with the invention, along a circular arc, to afford a smooth transition of the change in direction forces. By axially mobile guidance of the tubular envelope at these change in direction points, it is possible to make the tension member removable, if it is necessary to replace it. Spacers are located in these change in direction regions with the spacer forming openings to which the tension elements pass.

It is important in the method of installing such a tension member that the hollow space between the encased tension elements and the tubular envelope is filled with a hardenable material at least in the region of the change in direction before the tension member is stressed, so that the change in direction forces can be carried with a smooth transition. The axial mobility of the tension element with respect to the structure is, as a rule, also maintained in the region of the change in direction points. If differential forces are to be applied at the change in direction points, then a bonding between the tension elements and the structure must be produced. Such a bonding can be effected in a known manner.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In the drawings:

FIG. 20 is a partial axially extending section through an anchoring device embodying the resent invention and including another embodiment of an anchoring disc;

FIG. 21 is an enlarged sectional view of a portion of the anchoring device as shown in FIG. 20; and FIG. 22 is an axially extending view of a change in direction point of a tension member embodying the present invention shown partially in axially extending section and partially in side view.

DETAILED DESCRIPTION OF PREFERRED EMBODIMENTS OF THE PRESENT INVENTION

Figure 1:
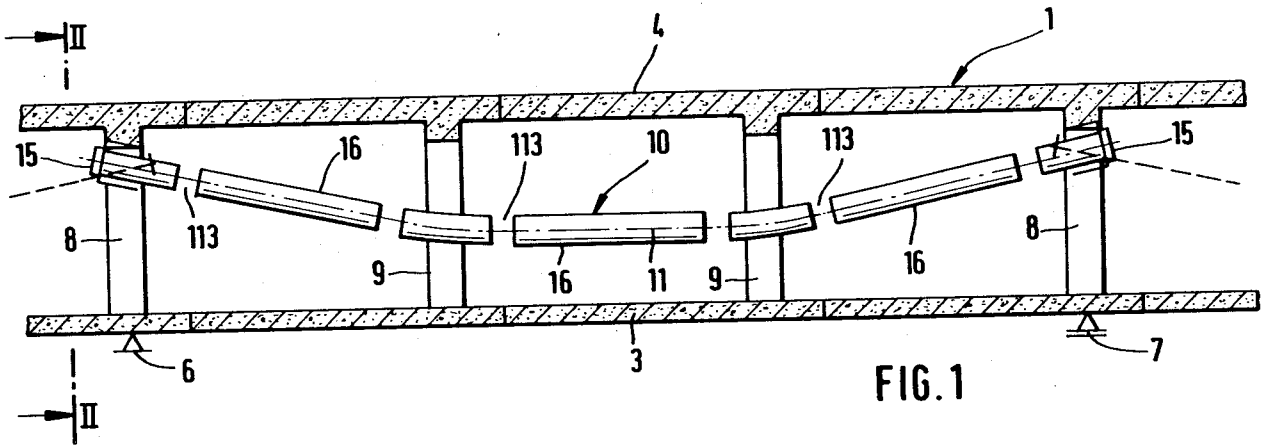
FIG. 1 is an axially extending view, partly in section, of a bridge support structure using tension members, in accordance with the present invention, as tendons with post-tensioning, with the view taken along line I—I in FIG. 2.
Figure 2:
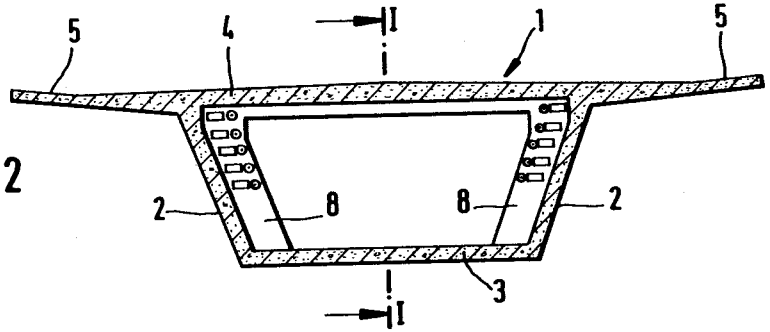
FIG. 2 is a transverse cross-sectional view through the bridge structure taken along the line II—II in FIG. 1.

In FIGS. 1 and 2, a bridge deck or roadway 1 is illustrated with a closed trapezoidally-shaped cross-section and the roadway is produced by the known incremental launching method. The bridge deck is formed of two elongated inclined girder webs 2, joined at their lower ends by a horizontal base plate 3, and at their upper end by a deck plate 4, extending between the upper ends of the webs and continued laterally outwardly from the webs by cantilevered sections 5.

The bridge deck 1 is prestressed by tension members or tendons with post-tensioning. In FIG. 1, which is not to scale, an axially extending section is provided and illustrates schematically one axially extending section of the bridge deck 1, between a fixed support 6, and a movable support 7, with the tension member 10 provided with an axis 11. In accordance with the characteristic of a continuous girder, the tension axis 11 shown in the cross-section of FIG. 2, is located in the upper part of the cross-section and in another part of the axial section in its lower region, not shown in FIG. 2. Within the deck cross-section, the tendons are located passing through the side pilaster members 8, where they are anchored and possibly overlap, as well as in the region of the pilaster members 9, in which the tendons undergo a change in direction, that is, they represent change in direction points. The pilaster members 8, 9 extend inwardly from the inside surfaces of the webs 2.

Figure 3:
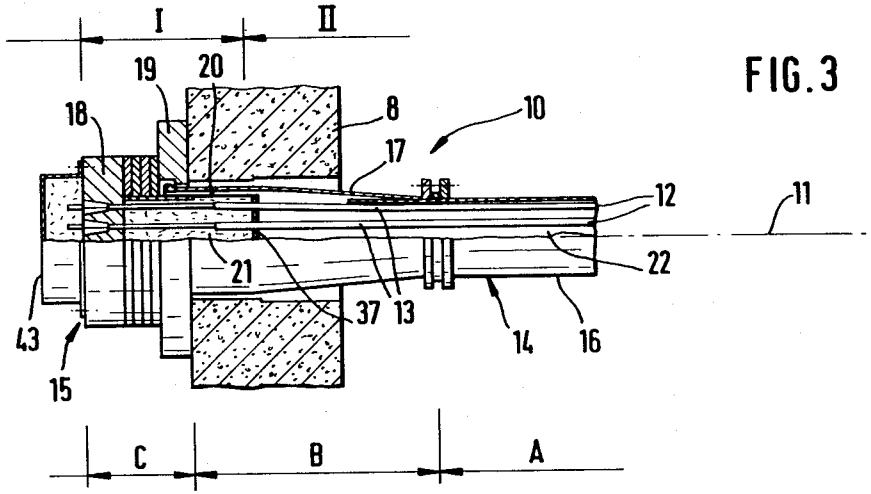
FIG. 3 is an enlarged view of an anchoring region in the bridge support structure.

An anchor region of the tension member 10 is displayed on a larger scale in FIG. 3, shown partially in axial section and partially in side view. The tension member 10 is made up of a bundle of tension elements, for instance strands 12 of steel wire, each enclosed within a casing or sheathing duct 13 for corrosion protection. The hollow space within the sheathing ducts 13, around the strands, is filled with a plastically deformable corrosion protection mass, such as grease. The strands or tension elements 12, located within the sheathing ducts 13 are enclosed within an axially extending tubular envelope 14. The tendon 10 abuts against a pilaster member 8 by means of an anchorage device 15.

Tubular envelope 14 in the normal or free region A of the tension member 12 is a plastics material sheathing tube, for instance, polyethylene, connected adjacent to the anchorage device 15 to a cast iron anchoring tube 17, with the tube widening in a trumpet-like manner toward the anchorage device 15. In the adjacent region B, forming a part of the anchor region, the spacing of the tension elements is increased towards an anchoring disc 18 for effecting the anchorage of the elements, that is, the over-all transverse cross-section of the tension member 10, formed by the elements 12, increases from the region A toward the anchorage. The anchoring disc 18 abuts against an abutment plate 19 bearing against one side of the pilaster member 8, this region is designated as region C forming part of the anchoring region.

The tension elements within the region B pass through the base plate of an anchoring pot 20, located within the anchoring tube 17 in a sealed manner. The anchoring pot is filled with a plastically deformable corrosion-protection material 21, such as grease. Note, in FIGS. 3 and 4, the regions I, II located above the anchorage. The region I extends from the anchoring disc to the base plate of the anchoring pot. In the region I, the tension elements 12 are axially movable in the corrosion protection mass 21 and in the outer region II, extending away from the anchoring pot are axially movable within the sheathing ducts 13. Externally of the anchoring pot 20 and in the region II, the hollow space or volume between the sheathing ducts 13 and the sheathing tube or envelope 16, is pressure injected with a hardenable material 22, for instance, cement mortar.

Figure 5:
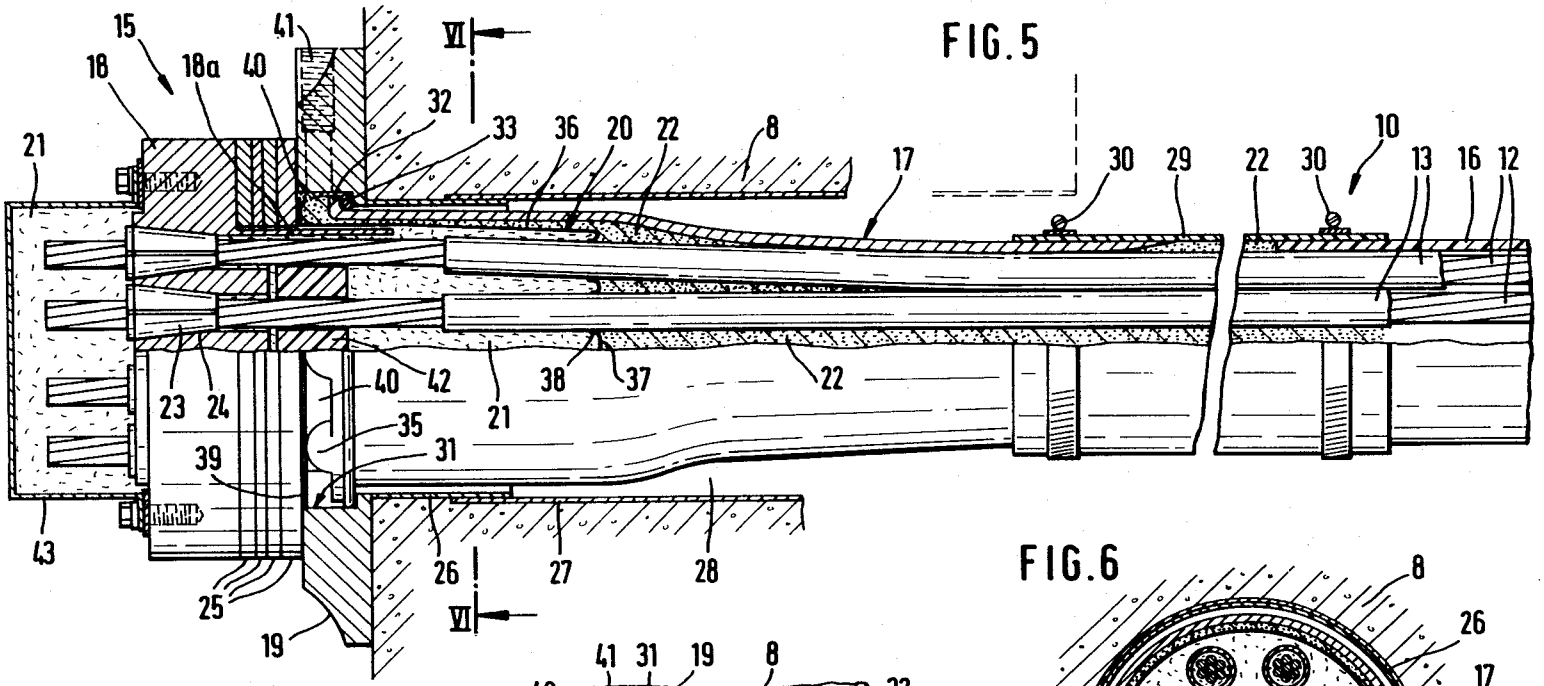
FIG. 5 is a view, partly in axial section, and partly in side view, on an enlarged scale, as compared to FIGS. 3 nd 4, illustrating the anchoring region of a tension member embodying the present invention.
Figure 6:
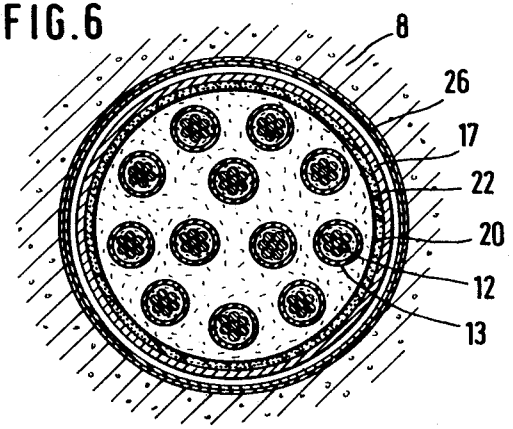
FIG. 6 is a transverse sectional view, taken along the line VI—VI in FIG. 5.
Figure 7:
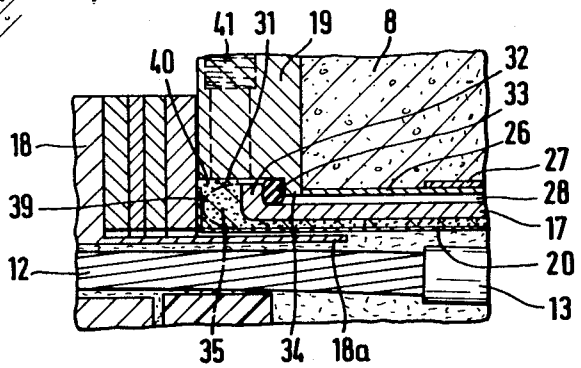
FIG. 7 is an enlarged partial view of a portion of the anchoring region in FIG. 5, and displayed on an enlarged scale.

The anchor region of the bundled tension member 10, shown only generally in FIG. 3, is displayed on a larger scale in FIGS. 5 to 7. Tension elements 12 are anchored in conical bores 24 within the anchoring disc by means of multi-part tapered collars or wedges 23. Anchoring disc 18 abuts via shims 25 against an abutment plate 19, and the abutment plate bears against the outside surface of the pilaster member 8, as shown in FIG. 5, or it can also be embedded in the pilaster member. Abutment plate 19 includes an axially extending tubular section 26 which extends into a tubular recess 27 with a slightly larger diameter than the tubular section with a recess 28 extending through the pilaster member and forming an opening through which the tension member 10 passes. Sheathing tube 16 is connected to the anchoring tube 17 adjacent to the anchorage, leaving an intermediate space. In the structure illustrated in FIG. 5, the connection between the tubes 16 and 17 is in the form of a butt joint made up of a sleeve 29, for instance, formed of plastics material, encircling the ends of the sheathing tube 16 and the anchoring tube 17, adjacent to one another, with the sleeve 29 fastened in place by clamps, such as hose connectors 30.

Anchoring tube 17 is formed of cast iron and thus is able to carry the change in direction forces generated by the widening of the spaces between the individual tension elements and passes through a opening in the abutment plate 19. In the detail in FIG. 7, anchoring tube 17 includes an outwardly bent flange 32 at its end, adjacent the anchorage, and the flange rests against an annular shoulder 34 in the abutment plate with the interposition of a sealing ring 33 made of an elastic material, for instance, rubber, with the annular shoulder narrowing the central opening 31 at the side of the abutment plate facing toward the anchoring pot 20. At its end, within the opening 31 in the abutment plate 19, the anchoring tube 17 is provided with protuberances 35 uniformly spaced in the circumferential direction with the protuberances extending radially outwardly, and also in the axial direction beyond the flange 32 toward the anchoring disc 18.

Figure 8:
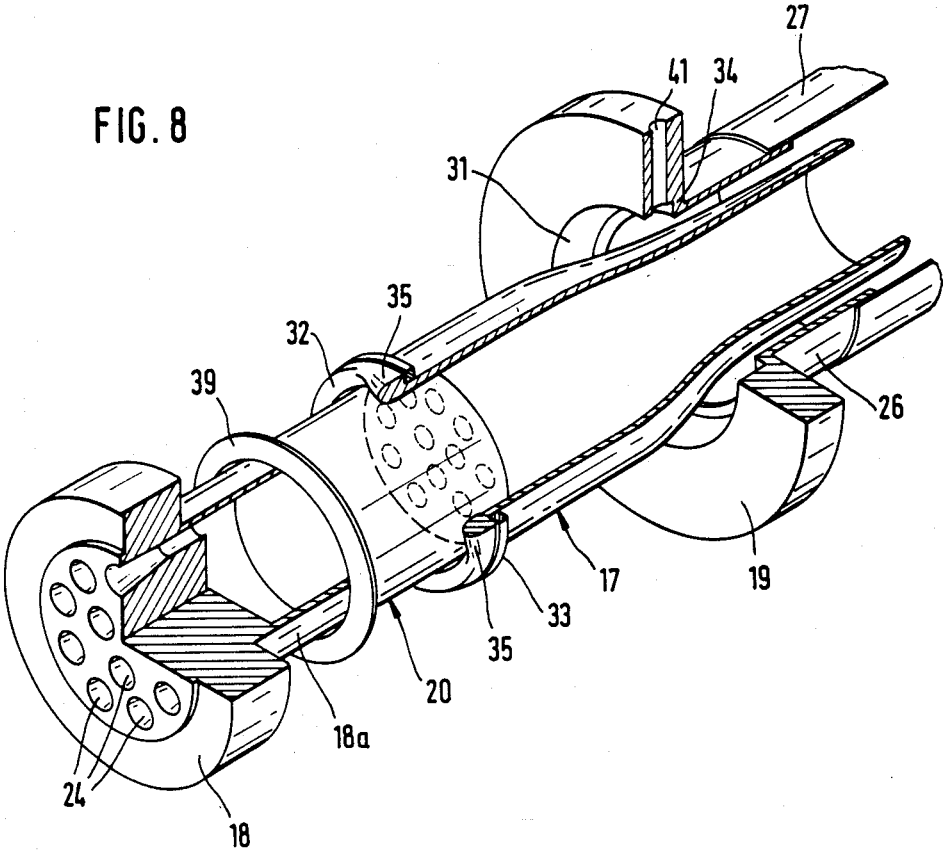
FIG. 8 is a exploded view of an anchoring region for the tension member of the present invention, and displayed partly in section.

As displayed best in FIG. 8, an anchoring pot 20 is inserted into the anchoring tube 17 and has an outside diameter at this location somewhat smaller than the inside diameter of the anchoring tube 17. Anchoring pot 20 is centered in the anchoring tube 17 by the radially inner portion of the protuberances 35, and is maintained from the inner surface of the anchoring tube so that an annular gap or space 36, note FIG. 5, is located between them. The anchoring pot 20 has a bottom or base 37 at its end more remote from the anchoring disc 18 and the base has a number of openings 38 so that the tension elements 12, along with their sheathing ducts 13 can pass through the openings. A tubular extension 18*a* on the anchoring disc 18, extends into the anchoring pot in the region of the abutment plate 19 and provides a centering action for the anchoring disc.

Anchoring pot 20 has a flange 39 at its end, closer to the anchoring disc 18, note FIG. 7, and the flange contacts the protuberances 35 on the flange 32 of the anchoring tube, that is the ends of the protuberances facing toward the anchoring disc 18. As a result, an annular space 40 is provided in the region of the abutment plate 19, limited inwardly by the anchoring pot 20, and radially outwardly by the surface of the opening 31 in the abutment plate 19, and on the opposite sides are the flanges 32 and 39 of the anchoring tube 17 and the anchoring pot 20. Several injection apertures 41 extend into the annular space 40 and pass through the abutment plate 19, note FIGS. 5 and 7. Annular space 40 is in flow communication with the inner hollow space within the sheathing tube 16, via the annular gap or space 36, between the anchoring pot 20 and the anchoring tube 17, so that the hollow space can be injected with hardenable material, for instance, cement mortar through the injection apertures 41, and a corresponding venting opening provided at the opposite anchorage.

From FIG. 5, it can be noted how the hollow space within the anchoring pot 20 is filled with a plastic corrosion-protection mass 21, such as grease, which assures the corrosion-protection in the region of the anchorage and permits subsequent detachment of the wedges 23 for retensioning or loosening the tension on the tension member 10 in order to replace it. Shims 25 also serve in reducing the tension. The corrosion-protection mass 21 has direct connection in the region of the anchoring pot 20 to the corresponding corrosion-protection mass within the sheathing ducts 13 enclosing the tension elements 12. The hollow space remaining between the sheathing ducts 13 and the inner surface of the over-all sheathing tube 16 can be injected through the annular space 40 and the annular gaps 36 with a hardenable corrosion-protection material 22, for instance cement mortar, which passes over the anchoring pot 20, filled with grease.

Figure 9:
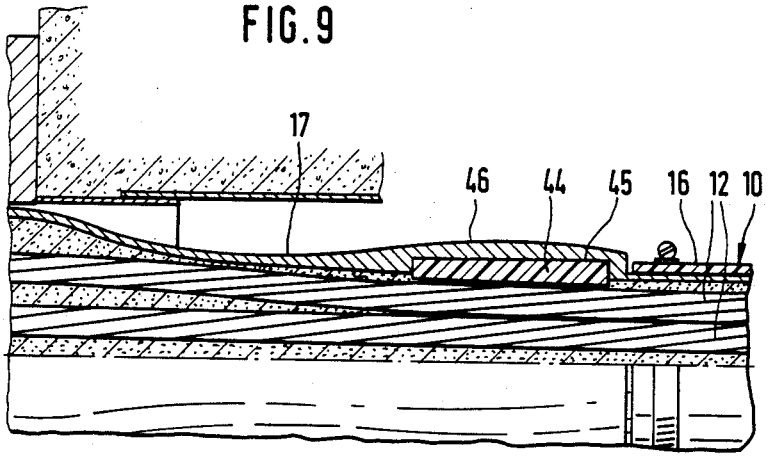
FIG. 9 is a partial axially extending section illustrating another embodiment of the anchoring region of a tension member, in accordance with the present invention.
Figure 10:
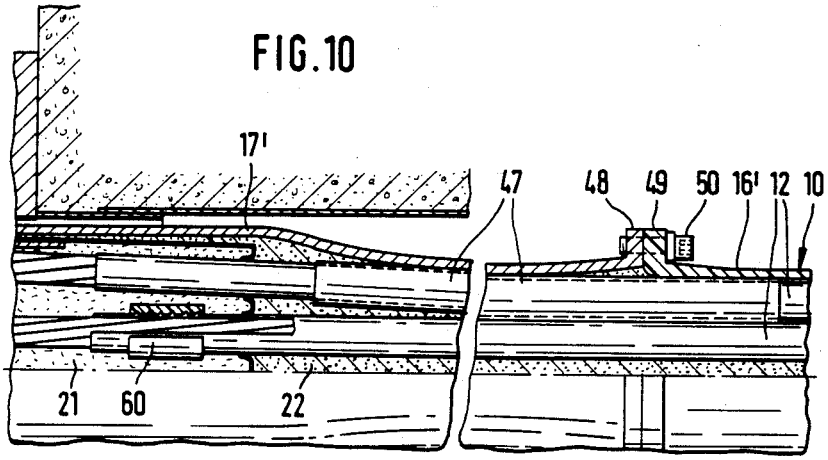
FIG. 10 is a view in axial section of the anchoring region of a tension member illustrating another embodiment of the present invention.
Figure 11:
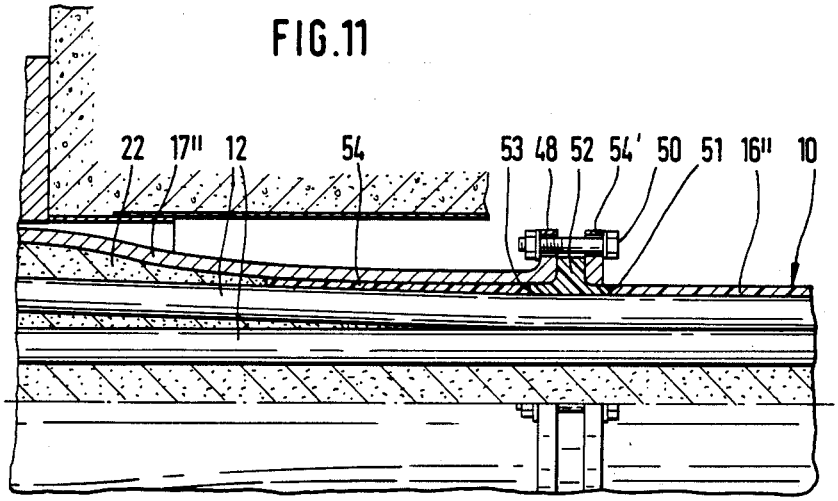
FIG. 11 is a view similar to FIG. 10 of still another embodiment of the anchoring region of a tension member in accordance with the present invention.

The condition in the region where the space between the tension elements is increased in the anchoring tube 17 is explained in detail with the aid of FIGS. 9, 10 and 11. At this location, it is necessary to redirect at least the tension elements located in the radially outer part of the bundle in a smooth transition and to guide them so that their metallic surface does not slide on the inner metallic surface of the anchoring tube during the tensioning step which interaction could cause frictional corrosion. Accordingly, as shown in FIG. 9, a ring 44 of a plastics material, for instance, polyethylene, is located in the portion of the anchoring tube where the increase in the spacing of the tension elements is commenced, note FIG. 9. Ring 44 is inserted into a widened portion 46 in the wall of the anchoring tube forming a seat 45 in the inside surface of the tube so that the ring projects inwardly from the inside surface and thus assures a smooth guidance of the tension elements in this region and a smooth transition of the redirection forces.

A similar effect can be achieved, as shown in FIG. 10, if the radially outer tension elements in the bundle are provided with sleeves 47 of plastics material. Further, FIG. 10 shows a connection between the anchoring tube 17 and the sheathing tube 16' in the free region of the tension member 10, that is, between and spaced from the anchorages. It is expedient in certain cases to form a solid connection between the two tubes forming the tubular envelope for the tension member. The connection can be achieved by providing the anchoring tube 17' and the sheathing tube 16' with flanges 48, 49, respectively, with the flanges connected in a tension-proof manner by screws 50.

Another embodiment for the connection of the sheathing tube to the anchoring tube in the free region of the tension member is illustrated in FIG. 11. Similar to the embodiment in FIG. 10, the anchoring tube 17'' has a outwardly directed flange 48 at one end, the sheathing tube 16'' is welded at its adjacent end by a welding seam 51, with an intermediate piece 52 of approximately T-shaped cross-section of the same material as the sheathing tube 16''. At the opposite end of the tubular inner portion of the intermediate piece 52, an axially extending tubular section 54 is secured by a welding seam 53 at the beginning of the trumpet-like expansion of the anchoring tube 17'' with its smooth lining affording support for the radially outer individual tension elements 12. In this embodiment, the sheathing tube 16'' with the intermediate piece 52 is lengthened for extending into the anchoring tube 17'' affording a continuous support for the individual tension elements 12 in this critical region. The radially projecting part of the intermediate piece bears against the flange 48 on the adjacent end of the anchoring tube 17'', and is secured to the flange by a ring 54' and bolts 50.

Figure 14:
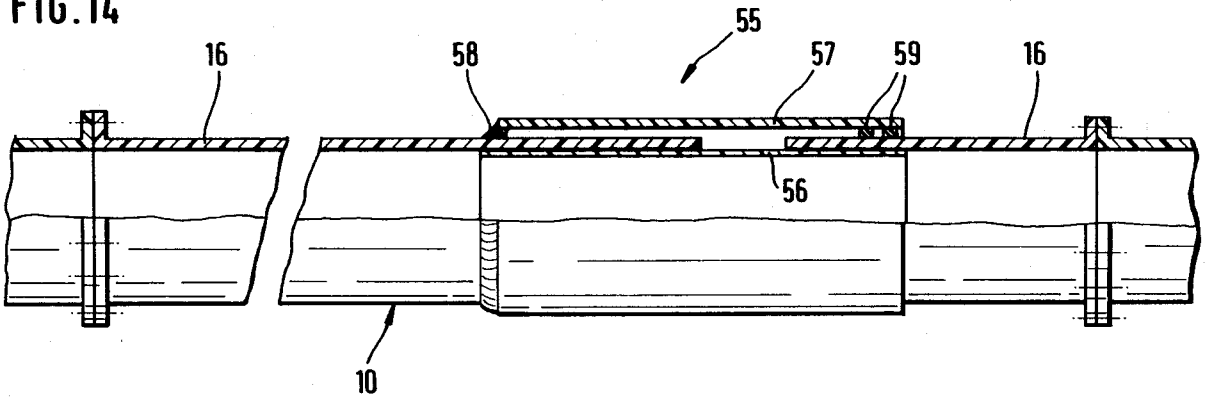
FIG. 14 is a schematic showing of an expansion joint in the tubular envelope for the tension member.

In view of this connection, to avoid excessive tension forces in the sheathing tube 16, caused by temperature differences, an expansion joint 55 can be provided at any point along the tension member 10, note FIG. 14. Since the external corrosion-protection system, that is, the tubular envelope for sheathing tube 16, is interrupted at the expansion joint, a leak-proof connection is provided. This feature is indicated in the illustrated embodiment by an inner tube 56 and an external tube 57, which is fastened at one end by a welding seam 58 and is sealed at its other end against the outside surface of the tubular envelope by sealing rings 59.

Figure 12:
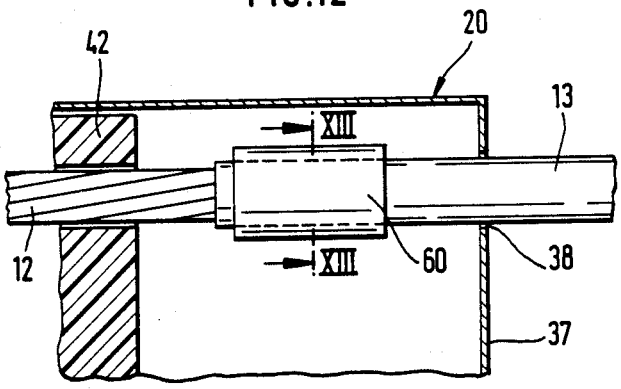
FIG. 12 is a partial axial view through a anchoring pot for fixing the sheathing duct of a tension element.
Figure 13:
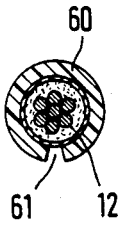
FIG. 13 is a transverse sectional view taken along the line XIII—XIII in FIG. 12.

When using the tension elements 12 with their sheathing ducts 13, according to the invention, attention must be paid to the fact, in changes of length in the sheathing ducts 13, due to temperature differences to which the tension member 10 is exposed, since it is not concreted into the structure, that the sheathing ducts do not slide out of the anchoring pot 20 filled with the corrosion-protection mass 22. In the case of short tendons where only minor changes in length occur, the axial length of the anchoring pot can be such that changes in length of the sheathing ducts 13 occurs within the limits of the actual length of the pot. With longer tension members, it is necessary to prevent extensive changes in the length of the sheathing ducts 13. This can be accomplished in a simple manner by fastening the ends of the sheathing ducts 13 within the anchoring pot 20 so that they cannot slide through the opening 38 in the base 37 of the anchoring pot 20. This can be achieved in various ways, some of which are illustrated in FIG. 10, as well as in FIGS. 12 and 13. A clamping sleeve 60, formed of a plastics material, is placed at the end of the sheathing duct 13 on a tension element 12, and the clamping sleeve is provided with a axially extending slot 61 and with ribs in its inside surface, that is, with an internal thread affording a friction and/or positive locking connection with the sheathing duct 13. A similar effect can be attained with hose clamps, tapered sleeves, or the like.

The assembly of the anchoring device described above is as follows: Initially, an abutment plate 19 is enclosed in concrete within a structural member, for instance, the pilaster member 8, shown in FIG. 3, in such a way that its axially extending tension tube 26, together with the tubular recess 27, forms an opening 28 for the tension member 10. After placement of the sheathing tube 16, which may be made up of several axially extending sections, if, as shown in FIG. 1, change in direction points are present, the anchoring tube 17, with the sealing ring 33, is provided at both ends and is connected to the sheathing tube 16. For axial mobility during assembly, the final connection occurs only at the anchoring end.

Next, tension elements 12, provided at both ends with numbered tags for identification, are slid from a coil into the sheathing tube 16 by a sliding-in device, not shown. When all of the tension elements have been inserted, an anchoring pot 20 is pushed on each of the ends of the tension member 10. Care must be taken that the numbered tension elements 12 reach corresponding openings 38 in the base 37 of the anchoring pots 20 at the opposite ends of the tension elements. The openings 38 are sealed to a degree by the sheathing ducts 13. Next, the sheathing ducts 13 on the tension elements 12, in the anchor region, can be removed and the anchoring pot filled with the pasty corrosion-protection mass 21, if it has not already been filled prior to this time.

A spacer 42 is then slid onto the tension elements 12, whereby the spacer prevents direct contact of the tension elements 12 with the anchoring disc 18, note FIG. 5, and maintains the parallel guidance of the tension elements, so that there is no reduction in the vibration strength. Subsequently, the anchoring disc 18 with its tubular extension **18*a* and the shims 25 are slipped on the ends of the tension elements and the corrosion-protection mass 21 is further compacted. Accordingly, the tubular extension 18*a* affords a self centering of the anchoring disc 18, while being slipped into the anchoring tube 17, note FIG. 8. Finally, the annular wedges 23 are inserted into the conical bores 24 in the anchoring disc 18**.

Subsequently, it is helpful to stretch the tension elements 12 individually with a light duty hydraulic press, prior to tensioning all of the tension elements together with a bundle tensioning press or jack. If necessary, the portions of the tension elements extending beyond the anchorage are cut off and a corrosion-protection mass is injected with the help of a grease gun through bores in the anchoring disc 18. For positive corrosion protection of the anchorage, a protective covering 43 is placed over the ends of the tension elements projecting outwardly from the anchorage and the covering is filled with a corrosion-protection mass 21, note FIG. 5. Whereupon, the positive connection of the casing with the anchorage and the connection of the sheathing tube 16 with the anchoring tube 17 can be effected and, finally, the hollow volume remaining within the free region of the sheathing tube 16 can be pressure-injected in the described manner through the injection openings 41 with a hardenable material, such as cement mortar.

To prevent cracks in the hardened cement mortar as a result of length changes of the tension member 10 due to temperature differences, since the cement mortar does not bond with the tension elements 12 or the sheathing tube 16, the cement mortar should be reinforced. Reinforcement can be provided by using grout in which glass fibers or the like have been added or into which one or more steel wires as reinforcement of the mortar along with the tension elements 12 within the sheathing tube 16.

Figure 4:
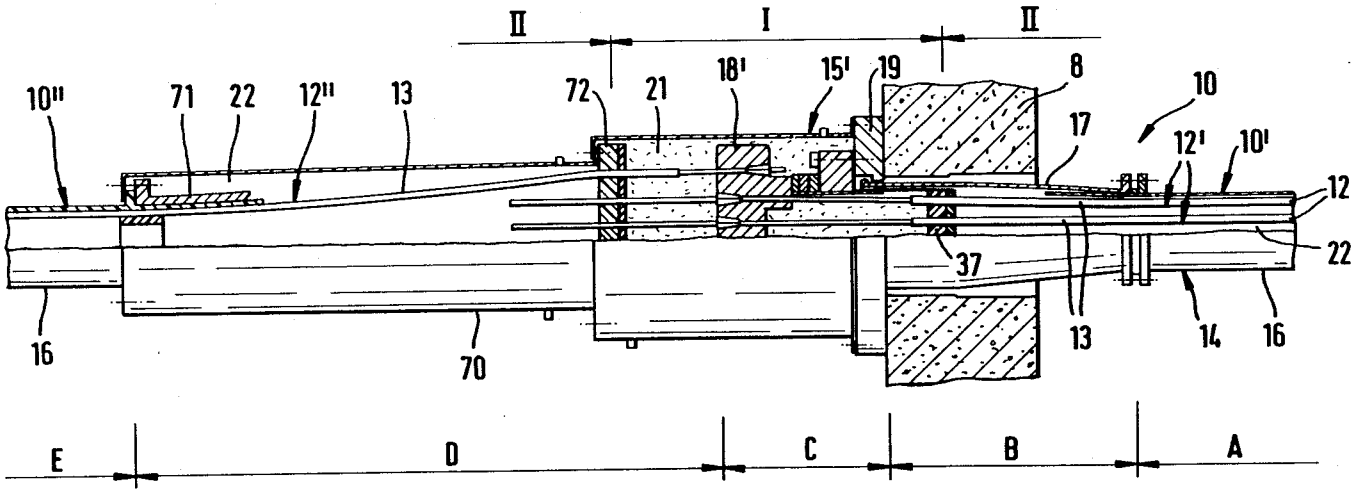
FIG. 4 is an axially extending sectional view of an anchoring and coupling region of the tension member embodying the present invention and corresponding to FIG. 3.

In FIG. 4 and in FIGS. 15 to 21, an anchorage or anchor point acting also as a coupling point is shown. In FIG. 4, such a combination is shown partly in axial section and partly in side view. Basically, the tension member 10 is designed in the same manner as shown in FIGS. 3 and 5. In this case, however, the tension member abuts only by means of the anchoring device 15', used only as an intermediate anchorage, against the pilaster member 8, forming part of a construction member, and is continued in the direction away from the pilaster member from the anchoring device 15'up to the next anchoring device designed as an end anchorage in accordance with FIGS. 3 and 5. The portion of the over-all tension member 10 to the right of the anchoring device 15' in FIG. 4 is designated as the "incoming" portion 10', while the portion to the left of the anchoring device 15' in the Figure is designated as the "outgoing" portion 10''.

The tubular envelope in the combined anchoring and coupling region C and in the adjacent region D of the outgoing portion 10'' of the tension member 10 is formed by a casing 70 designed differently as a function of the lateral spreading of the tension elements 12''. Primarily, the casing 70 is formed of metal, however, it can be made of plastics material, such as polyethylene. In FIG. 4, the casing 70 consists of two consecutive axially extending sections with stepped diameters affording a transition to the normal or free region E corresponding to the normal or free region A, where it is connected to a sheathing tube 16 made of plastics material, for instance, polyethylene. The casing serves not only for mechanical and corrosion protection of the coupling point, but also for securing a redirection member 71. If it is formed as a metal tube, it can also be used for the reduction of the bending moments.

Tension elements 12, enclosed by sheathing ducts 13, formed of polyethylene in the axially extending normal regions A and E, as well as in the regions B and C, where the spacing of the elements is varied, and or guided within the anchoring tube 17 through the base 37 of the anchor pot 20 in a sealed manner and on the opposite side of the anchoring device are guided in a sealed manner through a sealing washer 72. The base 37 and the sealing washer 72 form the axial bounds of the region I, note FIG. 4, of the tension member 10, in which the hollow space within the tubular envelope is filled with a plastically deformable corrosion-protection mass 21, for instance, grease, and in the remaining regions II on the opposite sides of the region I, of the tension member 10, the exterior of the anchoring pot 20, is pressure injected with hardenable material, such as cement mortar 22. The tension elements 12 are guided for axial mobility over the full length of the tension member 10 and are coupled in an overlapping manner in the region I adjacent the anchoring device 15 and filled with a corrosion-protection mass so that the tendon member 10 made up of several axially-extending portions 10', 10'' can be tensioned from the ends.

Figure 15:
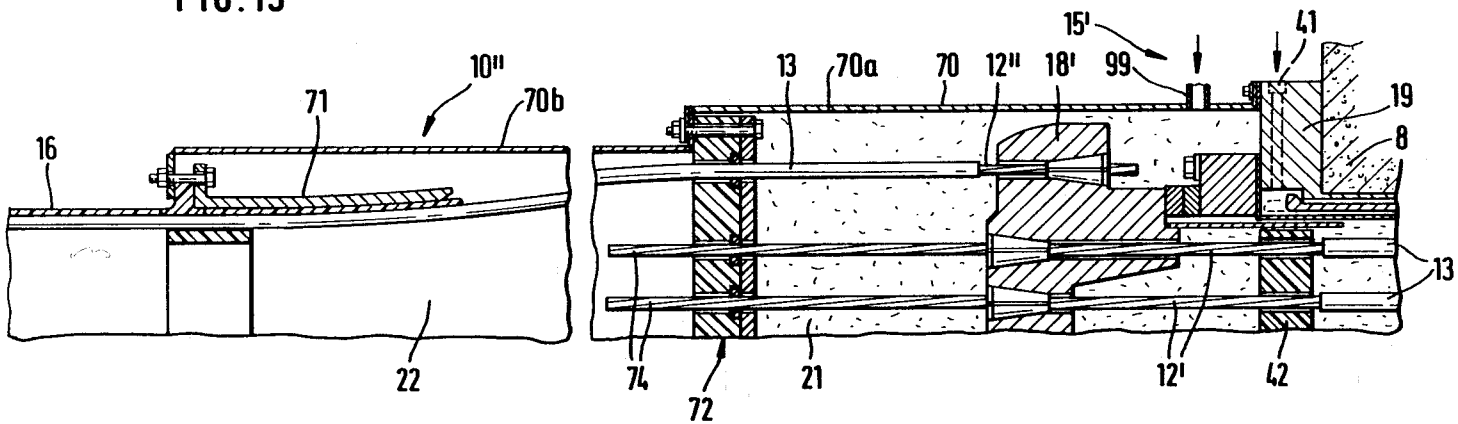
FIG. 15 displays a partial axial section of an anchoring and coupling region for a tension member embodying the present invention and set forth on an enlarged scale.
Figure 16:
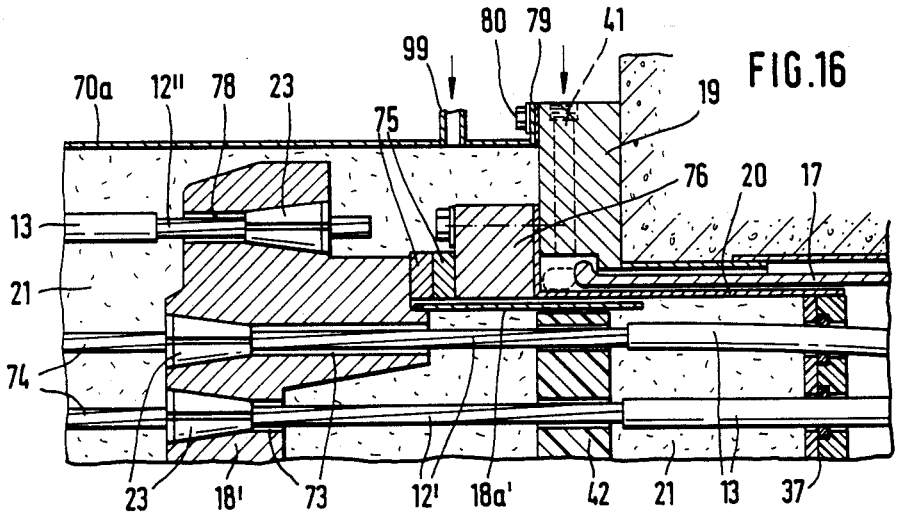
FIG. 16 is a partial axially extending section through an anchoring device with an anchoring disc.
Figure 17:
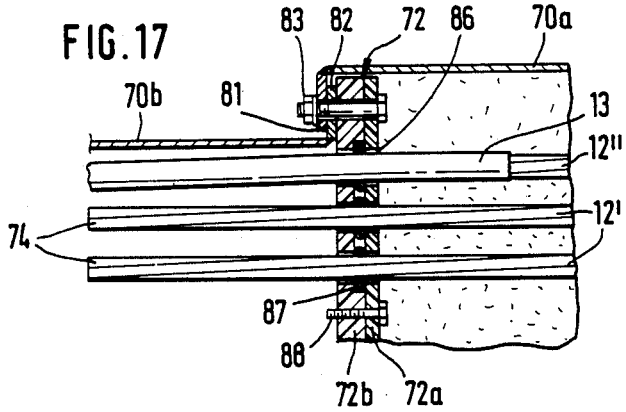
FIG. 17 is a partial axially extending section through a sealing disc in the region of the outgoing tension elements.
Figure 18:
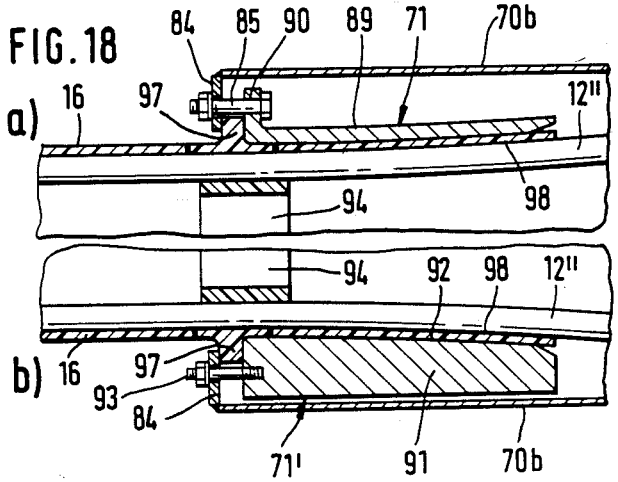
FIGS. 18*a* and 18*b* are, partial axially extending sections, at the end of the tension element widening region of the outgoing tension elements.

The outgoing portion 10'' of the tendon is shown at a larger scale in partial axial cross-section in FIG. 15 with the essential parts illustrated in detail in FIGS. 16, 17 and 18.

As can be determined from FIG. 16, the incoming tension elements 12', note FIG. 4, are kept in order in the region of the abutment member 19 by a spacer 42 and pass through bores 73 in the anchoring disc 18' and are anchored by wedges 23 extending into the frustoconical ends of the bores. The ends 74 of the tension elements 12' extend for a length beyond the anchoring disc 18' corresponding to the strain, so that it is possible to remove the tension from the entire tension member or tendon. The anchoring disc 18' abuts against shims 75 and presses an intermediate ring 76 against the abutment plate or member 19. Anchoring disc 18' is centered within a central opening in the abutment member 19 by an extension tube **18*a*'. While the incoming tension elements 12' are anchored in the central region of the anchoring disc 18', the outgoing tension elements 12'' are anchored in the radially outer region of the anchoring disc outwardly from the incoming tension elements 12'. Accordingly, the tension elements can be placed more easily in the required order. Moreover, the outgoing tension elements 12'' are accessible from the outside in the bores 78 so that the wedges 23** can be inserted in place.

To return the tension elements 12'', shown in parallel, from the position in the anchoring disc 18' to the spacing in the normal region E, a double change in direction is required, note FIG. 15. The first change in direction of the tension element guided in a parallel member in the anchoring disc towards the inside, takes place in the region of the sealing washer 72 which is arranged so that it can carry the change in direction forces oriented inwardly. The second change in direction of the tension elements 12'' takes place in the region of the redirection member 71 which must be able to carry the outwardly directed change in direction forces as annular tension forces. This, which is possible, the tension elements 12'' extending obliquely outward in the direction of their increased spacing, are anchored in appropriately oriented bores in the anchor ring disc 18', then it is not necessary to provide a change in direction in the region of the sealing washer 72.

Casing 70 forms the tubular enclosure 14 of the tension member 10 in the region C of the coupling and in the region D where the spacing of the tension elements changes from the enlarged cross-section to the normal cross-section. Casing 70 is made up of two axially extending parts with different diameters **70*a* and 70*b*, note FIGS. 16–18. The larger diameter section 70*a*, has an outwardly bent flange 79 fastened by means of bolts 80 to the abutment member 19, note FIG. 16. At its opposite end, the section 70*a* has an inwardly bent flange 81 connected by means of bolts 83 with the adjacent smaller diameter section 70*b*, overlapping the flange 82, extending outwardly from the adjacent section 70*b*. Section 70*b*, note FIG. 18*a*, has an inwardly extending flange 84 to which a connection is made by bolts 85 between the sheathing tube 16 in the free region of the tension member 10 and the redirection or change in direction member 71. The two consecutive axially extending sections 70*a*, 70*b* of the casing 70, are longitudinally displaceable in a telescopic manner relative to one another and to the adjacent sheathing tube 16, as is appropriate during installation and disassembly or during removal of tension on the individual tension elements of the tension member 10**.

The sealing washer 72 is formed of two plates **72*a*, 72*b*, note FIG. 17, provided with registered bores for the passage of the tension elements 12. Outer plate 72*b*, more remote from the anchoring disc 18', is somewhat thicker in the embodiment as shown so as to carry the change in direction forces. At the inner side of the washer 72, the bores are provided with stepped diameters, and sealing rings 87 are inserted into the increased diameter parts encircling one-bare tension element 12' or a strand with a sheathing duct 13, whereby the sealing rings rest in a leak-proof manner against the tension element or are deformed so as to form a seal by pressing on the inner plate 72*a* by one or more bolts 88**.

The redirection member 71 effecting the change in direction of the tension elements 12'' in the outward direction consists in the embodiment of FIG. **18*a* of a tubular section and while forming a contact surface for the tension elements 12' widens in a trumpet-like manner with a defined unwinding radius and has at its outer end an outwardly directed flange 90 drilled in the same manner as the flange 84 for receiving the bolts 85. In the embodiment of FIG. 18*b*, the redirection member 71' is formed of a solid annularly-shaped molded member 91 of greater thickness than the redirection member 71. The redirection member 71' has an appropriately curved radially inner surface 92, and has threaded bores in its end surface facing the flange 84 for receiving attachment bolts 93. To fasten the tension elements 12' in position until they are tensioned, an expansion ring 94 made of a plastics material is inserted inwardly of the redirection member 71 or 71'**.

Figure 19:
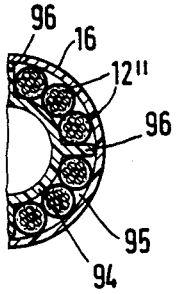
FIG. 19 is a partial transverse sectional view through the outgoing tension elements shown in FIGS. 18*a* and 18*b;*

Expansion ring 94 is shown in partial transverse section in FIG. 19 and serves at the same time for arranging the tension elements 12'' in an annularly-shaped order. Accordingly, a number of receptacles or open spaces 95 are provided around the outer circumference of the expansion ring 94 with the individual receptacles spaced apart by radially projecting webs 96.

In the installation or assembly of a tension member 10 with increased length due to the coupling point, the incoming tension elements 12' are anchored after tensioning in the anchoring disc 18' as previously described. The anchoring disc 18' abuts against the abutment member 19 through shims 75 and the intermediate ring 76 used for diameter equalization. Shims 75 are divided into two or more parts so that they can be removed later if tension is to be removed from the tension member. Intermediate ring 76 can be fastened by bolting it to the abutment member 19.

The two axially extending sections 70*a*, 70*b* of the casing 70 are fabricated separately and initially are slid over the sheathing tube 16 which has been readied for installation, prior to welding the flange 97 and part 98 continuing the sheathing tube at its end by means of a butt weld.

The redirection member 71 is then slipped onto the part 98, note FIGS. 18*a*, 18*b*. Next, the outgoing tension elements 12" are placed into the sheathing tube 16 in he direction of the anchoring device 15 and the sheathing ducts 13 are stripped from the ends of the tension element for approximating the thickness of the anchoring disc 18'. The tubular part 98 continuing the sheathing tube 16, serves as an intermediate layer during the tensioning of the tension elements 12', to prevent metal-to-metal contact between the tension element and the redirection number 71. The tubular section 98 is deformed to conform with the change in direction of the tension elements 12".

Thereupon, the sealing washer 72 is installed. In this operation, the outer plate 72*b* is slid on and the sealing rings 87 are threaded on, note FIG. 17. Next, the inner plate 72*a* is positioned and both plates are aligned relative to one another and are connected to one another by the bolts 88. As a result, the sealing rings are compressed and the sealing force is activated. In the next operation, the sections 70*a*, 70*b* of the casing 70 are displaced in a telescoping manner toward the anchoring device 15' and are bolted to the abutment member 19 and to the sealing washer 72, as well as with the redirection member 71. At the same time, the sheathing tube 16 is fastened to the anchoring device 15' by positioning the flange 97 between the flanges on the portion 70*b* and the redirection member 71.

Before or only after tensioning of the tension elements 12', the corrosion-protection mass 21 is pressure injected into the region of the coupling point, and hardenable material 22, such as cement paste, is pressure injected into the remaining regions. Accordingly, injection tubes 99 are provided in the casing 70 and injection openings 41 in the abutment member 19, note FIG. 16. The projecting ends 74 of the incoming tension elements 12' are protected by polyetylene tubes inserted on them, note FIG. 16.

If tension is to be released from the tension number 10, then the procedure above is reversed, starting with the outgoing tension elements 12" and following with the incoming tension elements 12' being relieved of tension. If only a partial release of tension is to be effected in the individual sections 10' or 10" of the tension member 10, then only that section 70*a* of the casing 70 is displaced until the anchoring disc 18' is accessible, then the section 10" of the tension member 10 is tensioned to the extent that the intermediate ring 76 lifts off the abutment member 19 and the shim 75 can be removed. After renewed relaxation of the anchoring disc 18' upon the intermediate ring 76, the elongation is reduced by the thickness of the shims and with this also the tension force. A possible displacement of the end of the sheathing tube 16 in carrying out this procedure can be prevented, for instance by providing support against the abutment member.

Another embodiment of the anchoring disc is displayed in FIGS. 20 and 21 which affords the possibility for placement of the anchoring disc against the abutment member 19 without the use of an intermediate ring 76.

The bores 73 for anchoring the tension elements 12' in the anchoring disc 18" by means of the wedges 23 are arranged in the same manner as in the anchoring disc 18' as previously described. The anchoring disc 18 has an increased thickness in the region of the bores 78 for anchoring the outgoing tension elements 12' by means of the wedges 23 so that a support surface 100 is formed with which the radially outer part of the anchoring disc 18" abuts against the abutment member 19 with the interposition of the shims 75 provided for the possible release of the tension.

In this embodiment, since the anchoring points for the outgoing tension elements 12" are no longer accessible after the installation of the anchoring disc 18" and the tensioning of the incoming tension elements 12', it must be possible to subsequently insert the outgoing tension elements 12" and to anchor them securely. Accordingly, the bores 78 are extended from the frustoconical section, arranged for the insertion of the wedges, toward the abutment number 19, by a cylindrically shaped widened section 101 in which a pressure spring 102 is arranged bearing against the surfaces of the wedges. A sleeve 103 bears against the free end of the pressure spring 102 and this sleeve is held in place by a snap ring 104 insertable into an annular groove 105, note FIG. 21. In this manner, the wedges 23 can be fastened in position.

When a tension element 12" is being inserted, the pressure spring 102, can be compressed somewhat so that the wedges can be opened permitting the tension elements to pass through them. It is, however, assured by the pressure spring that the inserted strand is securely held by the wedge to prevent any retreating motion. The space formed by the widened section 101 of the bore 78 is filled with the corrosion-protection mass, the corrosion-protection mass 21 can be subsequently injected through a tubular opening 106 accessible on the outside of the anchoring disc 18'.

If, as indicated in FIG. 1, a tension member 10 runs along a path with a number of changes in direction points, then apart from the anchoring regions, the change in direction regions are designed in a specific manner so that a smooth transition of the change in direction forces is effected. One embodiment for such a change in direction point is illustrated in FIG. 22, partly in axial section and partly in side view.

The tubular envelope for the tension member 10 in the region of the change in direction point is formed by the continuously pre-bent steel tube 110, preferably in the shape of a circular arc, which is capable of transferring the change in direction forces at the inner side of the curvature to the structural member, in FIG. 22, the pilaster member 8. Steel tube 110 is either encased in the concrete of the pilaster member or, if it is to be axially movable, with respect to the pilaster member, it is placed in a formwork tube encased in the concrete.

In the region of the change in direction point, the tension elements must be arranged in an orderly manner, whereby spacers 112 are provided in this region which have openings through which the tension elements 12 extend. For the installation of the spacers 112, there are several possibilities, installation intermediate spacers are allowed to remain at the change in direction points in the tubular envelope or in the sheathing tube 16 in order to stop the tension elements 12 during the pushing-in operation and to be able to thread them into appropriate openings in the spacer, or to install the spacers in another manner for subsequently moving them into the predetermined position at the change of direction point by axial displacement along the tension member or together with the tension member.

To provide a smooth transition of the change of direction forces in the region of the change in direction points during tensioning of the tension member 10, the region of the curved sheathing tube 110 can, before the tensioning, be injected with hardenable material 22, for instance, cement mortar. For this purpose, the sheathing tube is sealed at both of its ends. The sealing action can be effected by insert pieces 114, constructed similar to the anchoring pot 20, note FIG. 5. The insert pieces 114 are placed into the sheathing tube from the ends and have a base provided with openings for passing the tension elements through them. The hollow space formed by the insert pieces is to be filled with a hardenable material, such as cement mortar. At one end, an injection hose 115 projects into the curved sheathing tube and a venting tube or opening is provided at the other end so that any open volume remaining within the sheathing tube 110 and around the sheathing ducts 13 of the strands 12 is filled with the hardenable material, that is, cement mortar. After the material has hardened, the tension elements remain axially movable within their sheathing ducts 13 and can be tensioned. The strands 12 with the sheathing ducts 13 can for additional protection also extend through separate guidance tubelets formed of plastics material along the length of the change in direction region.

In a similar manner it is also possible beforehand to inject the sheathing tube with previously installed spacers and guidance tubelets and to position it in the prefabricated state.

Finally, it is possible to provide a smooth redirection of the tension elements 12 at the change in direction point so that spacers 112 formed of a plastic material are arranged in a sealed manner next to one another with aligned openings.

The described placement of the spacers assumes segmental injection of the entire cavity within the tubular sheathing. To be able to fill the entire cavity after tensioning of the tension member, it is also possible to design the spacers in such a way and from such a material that they can carry the change in direction forces developed during the tensioning step and thus transmit the forces to the structural member. This can be achieved if the spacers are formed of metal, such as cast iron. In addition to passageways for the tension elements, the spacers must also provide passages for the injected hardenable material.

The connection of the curved sheathing tube 110 with the adjacent parts of the sheathing tube 16 can, while bridging over the intermediate spacers, take place in the manner described in connection with FIG. 5, by sleeves and hose connectors, and also by means of the bolt-connected flanges described in FIG. 11.

While specific embodiments of the invention have been shown and described in detail to illustrate the application of the inventive principles, it will be understood that the invention may be embodied otherwise without departing from such principles.

We claim:

1. Corrosion-protected tension member, such as a tendon for prestressed concrete with post-tensioning, comprising at least one axially extending steel tension element located within a tubular envelope, and with an anchoring device having an abutment member at each end thereof, said tension element has an anchor region where it is connected to said anchoring device and a free region extending between the anchor regions, said tubular envelope comprises a sheathing tube in the free region of said tension member connected in the anchor region to said anchoring device, said tubular envelope enclosing an open space around said tension element and said open space filled with a plastically deformable corrosion protection mass in the region directly adjacent to said anchoring device, wherein the improvement comprises that said tension member comprises a plurality of axially extending tension elements and each said tension element is located within a separate sheathing duct formed of a plastics material located within said sheathing tube and with a space located within said sheathing duct around said tension element and with said space within said sheathing duct filled with a plastically deformable corrosion-protection mass, said open space within said sheathing tube exteriorally of said sheathing ducts and extending between the anchor regions being filled with a hardenable material, said tubular envelope in the anchor regions comprises an anchoring tube located within an opening in the abutment member and extending from said abutment member toward the free region of the tension member and being filled with hardenable material, an anchoring pot located within said anchoring tube, said anchoring pot comprises annular side walls spaced inwardly from the anchoring tube wherein the hardenable material extends into the space therebetween and a base at its end more remote from said abutment member having a plurality of openings corresponding to the member of tension elements, and said anchoring pot being filled with a plastically deformable corrosion-resistant mass wherein the tension elements extend between and through the anchoring pots.

2. Corrosion-protected tension member, as set forth in claim 1, wherein said anchoring pot is spaced inwardly from said anchoring tube and with an annular space located therebetween, and said anchoring pot has a flange extending outwardly at its opposite end from said base and another annular space encircling said anchoring pot at said flange being in communication with the annular space between said anchoring pot and said anchoring tube.

3. Corrosion-protected tension member, as set forth in claim 2, wherein an anchoring disc bears against said abutment member on the opposite side of said abutment member from the free region and said tension elements extending from said anchoring pot through openings in said anchoring disc, and at least one injection opening and one venting opening connected to one of said annular spaces and another annular space for charging hardenable material therein.

4. Corrosion-protected tension member, as set forth in claim 3, wherein said opening is said abutment member is a central opening and said anchoring tube extends into said central opening through said abutment member and said central opening forms an annular shoulder, said anchoring tube has an outwardly directed flange located within the central opening in said abutment member bearing against the annular shoulder therein.

5. Corrosion-protected tension member, as set forth in claim 4, wherein a sealing ring formed of an elastic material is located between said flange on said anchoring tube and said annular shoulder in the central opening through said abutment member.

6. Corrosion-protected tension member, as set forth in claim 5, wherein said anchoring tube has an end at which said flange is located within the central opening in said abutment member and the end of said anchoring tube having protuberances spaced around its circumference with said protuberances bearing against said flange on said anchoring pot.

7. Corrosion-protected tension member, as set forth in claim 6, wherein said anchoring disc has an axially extending tubular extension extending from a surface of said anchoring disc facing said abutment member and said tubular extension being telescopically inserted into said anchoring pot.

8. Corrosion-protected tension member, as set forth in claim 7, wherein said anchoring tube widens in a trumpet-like manner in the direction toward said anchoring disc.

9. Corrosion-protected tension member, as set forth in claim 8, wherein an intermediate layer formed of at least one of an elastically deformable material and a plastically deformable material, located between the inner surface of said anchoring tube and the adjacent tension elements in the region of the trumpet-like shape anchoring tube for affording smooth transition of change in direction forces of said tension elements.

10. Corrosion-protected tension member, as set forth in claim 9, wherein said intermediate layer is a ring bearing against the inner surface of said anchoring tube.

11. Corrosion-protected tension member, as set forth in claim 9, wherein at least said tension elements located adjacent said anchoring tube are enclosed within a covering sleeve formed of a plastics material.

12. Corrosion-protected tension member, as set forth in claim 9, wherein for relatively short said tension elements, the length of said anchoring pot is selected so that with any changes in length of said sheathing ducts due to temperature differences, the ends of said sheathing ducts do not separate outwardly from said anchoring pot.

13. Corrosion-protected tension member, as set forth in claim 9, wherein for comparatively long said tension elements, said plastics material sheathing ducts are secured within said anchoring pot for preventing displacement of said sheathing ducts out of said anchoring pot by enlarging the circumferences of said sheathing ducts.

14. Corrosion-protected tension member, as set forth in claim 13, wherein said anchoring tube is connected with said sheathing tube in the free region of said tension member.

15. Corrosion-protected tension member, as set forth in claim 14, wherein an expansion joint is provided along the axial length of said tension member for compensating for length changes due to temperature differences wherein said sheathing tube has a butt-joint in the free region with an external sleeve enclosing the butt-joint and extending therefrom in both directions and having one end secured to said sheathing tube.

16. Corrosion-protected tension member, as set forth in claim 1, wherein the hardenable material filled into the open space between said sheathing ducts and said sheathing tube includes reinforcement.

17. Corrosion-protection tension member, as set forth in claim 1, wherein at least one of said anchoring devices provides a coupling point for coupling tension elements extending from both sides of said anchoring device, said anchoring device comprises an anchoring disc abutting against said abutment member and having first bores for anchoring incoming tension elements from one side of said anchoring disc and second bores for anchoring outgoing tension elements located on the other side of said anchoring disc and in the axially extending region of said outgoing tension elements spaced from said anchoring disc a sealing washer defines one end of the open space formed by said tubular envelope with openings in said sealing washer for the passage therethrough of at least said outgoing tension elements and the open space between said sealing washer and said anchoring device is filled with a plastically deformable corrosion-protection mass.

18. Corrosion-protected tension member, as set forth in claim 17, wherein said tubular envelope about said outgoing tension elements comprises an axially extending casing in the region adjacent said anchoring device and said casing is detachably connected to said anchoring device and to said sheathing tube in the free region of said tension member spaced from said anchoring device.

19. Corrosion-protected tension member, as set forth in claim 18, wherein said anchoring disc has a radially inner central region and a radially outer region around said central region, said bores for anchoring said incoming tension elements being located in the central region and said bores for anchoring said outgoing tension elements being located in said outer region.

20. Corrosion-protected tension member, as set forth in claim 19, wherein said casing for said outgoing tension elements comprises a first and a second axially extending section with each of said sections having a different diameter.

21. Corrosion-protected tension member, as set forth in claim 20, wherein each of said different diameter sections of said casing is separate from the other.

22. Corrosion-protected tension member, as set forth in claim 21, wherein said separate sections of said casing are detachably connected together.

23. Corrosion-protected tension member, as set forth in claim 22, wherein said sections of said casing are displaceable relative to one another in a telescopic fashion.

24. Corrosion-protected tension member, as set forth in claim 20, wherein a sealing washer is arranged at a point located at the connection between the separate sections of said casing.

25. Corrosion-protected tension member, as set forth in claim 24, wherein said sealing washer is detachably connected with said casing.

26. Corrosion-protected tension member, as set forth in claim 25, wherein said sealing washer is formed as a spacer for said tension elements passing therethrough and said sealing washer being located at a change in direction point of said tension elements for absorbing change in direction forces resulting from the change in direction of said tension elements.

27. Corrosion-protected tension member, as set forth in claim 17, wherein said sealing washer is formed of two plates pressed against one another with openings through said plates for said tension elements and sealing rings located within the openings for effecting a sealing action around said tension elements.

28. Corrosion-protected tension member, as set forth in claim 18, wherein a redirection member is located at a change in direction point of said tension elements and said redirection member is ring shaped for absorbing change in direction forces oriented radially outwards at the location where the spacing between said tension elements commences to be increased.

29. Corrosion-protection tension member, as set forth in claim 28, wherein said redirection member is located within said casing and is detachably connected thereto.

30. Corrosion-protection tension member, as set forth in claim 29, wherein said sheathing tube enclosing said tension elements in the free region of said tension member extends into and through said redirection member in contact therewith and forms an intermediate layer located between said tension elements and said redirection member.

31. Corrosion-protected tension member, as set forth in claim 28, wherein an expansion ring is arranged for spacing the outgoing tension elements in the region of said redirection member.

32. Corrosion-protected tension member, as set forth in claim 31, wherein said expansion ring has an outer circumference forming a plurality of openings for securing said tension elements one of individually and in groups.

33. Corrosion-protected tension member, as set forth in claim 32, wherein said openings are separated by radially extending webs formed on said expansion ring.

34. Corrosion-protected tension member, as set forth in claim 33, wherein said expansion ring is formed as a sealing disc.

35. Corrosion-protected tension member, as set forth in claim 34, wherein said expansion ring is formed of a plastics material.

36. Corrosion-protected tension member, as set forth in claim 1, wherein said tension member has at least one change in direction point and said tubular envelope at said change in direction point is formed of a continuously bent tube extending along a circular arc.

37. Corrosion-protected tension member, as set forth in claim 36, wherein said tube extending along a circular arc is arranged to be axially movable relative to a structural member cooperating with said tension member.

38. Corrosion-protected tension member, as set forth in claim 37, wherein spacers are located within said circular arc tube in the region of the change in direction point with the diameter of said spacers being less than the inside diameter of said circular arc tube and having openings therethrough so that one said tension element can extend through each of said openings.

39. Corrosion-protected tension member, as set forth in claim 1, wherein said corrosion protection mass is grease.

40. Corrosion-protected tension member, as set forth in claim 35, wherein said expansion ring is formed of polyethylene.

41. Corrosion-protected tension member, as set forth in claim 36, wherein said circular arc tube is a steel tube.

* * * * *